US011052459B2

(12) United States Patent
Higa

(10) Patent No.: US 11,052,459 B2
(45) Date of Patent: Jul. 6, 2021

(54) SUBMERGED ENTRY NOZZLE FOR CONTINUOUS CASTING

(71) Applicant: AK Steel Properties, Inc., West Chester, OH (US)

(72) Inventor: Ken Morales Higa, West Chester, OH (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 96 days.

(21) Appl. No.: 16/256,208

(22) Filed: Jan. 24, 2019

(65) Prior Publication Data

US 2019/0232364 A1 Aug. 1, 2019

Related U.S. Application Data

(60) Provisional application No. 62/622,363, filed on Jan. 26, 2018.

(51) Int. Cl.
*B22D 41/50* (2006.01)
*B22D 11/10* (2006.01)

(52) U.S. Cl.
CPC ..... *B22D 41/50* (2013.01); *B22D 11/10* (2013.01)

(58) Field of Classification Search
CPC ..... B22D 11/10; B22D 41/50
USPC ..... 222/591, 594, 606, 607; 266/236
See application file for complete search history.

(56) References Cited

U.S. PATENT DOCUMENTS

| | | | | |
|---|---|---|---|---|
| 6,027,051 | A | 2/2000 | Heaslip et al. | |
| 2006/0118272 | A1* | 6/2006 | Sahai | B22D 11/041 164/488 |
| 2012/0227924 | A1* | 9/2012 | Miki | B22D 11/115 164/468 |
| 2014/0042192 | A1 | 2/2014 | Morales et al. | |

FOREIGN PATENT DOCUMENTS

| | | | | |
|---|---|---|---|---|
| JP | 60021171 A | * | 2/1985 | B22D 11/0642 |
| JP | 62137154 A | * | 6/1987 | B22D 41/50 |
| JP | 2003181603 A | * | 7/2003 | |
| KR | 20070056935 A | * | 6/2007 | B22D 11/168 |
| WO | WO 2009/057340 A1 | | 5/2009 | |

OTHER PUBLICATIONS

International Search Report and Written Opinion dated Mar. 12, 2019 for International Application No. PCT/US2019/014910, 15 pages.

* cited by examiner

*Primary Examiner* — Kevin E Yoon
(74) *Attorney, Agent, or Firm* — Frost Brown Todd LLC

(57) ABSTRACT

A submerged entry nozzle for a continuous casting process includes a pair of triangular shaped ports that narrow from a top portion to a bottom portion of the ports. These triangular shaped ports may improve fluid flow at the discharge of the ports by increasing the velocity of the liquid steel exiting the nozzle and into the mold.

14 Claims, 14 Drawing Sheets

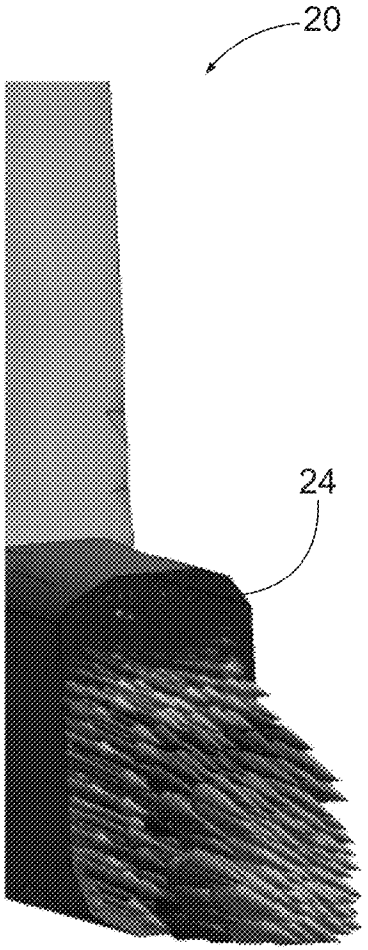
FIG. 14B
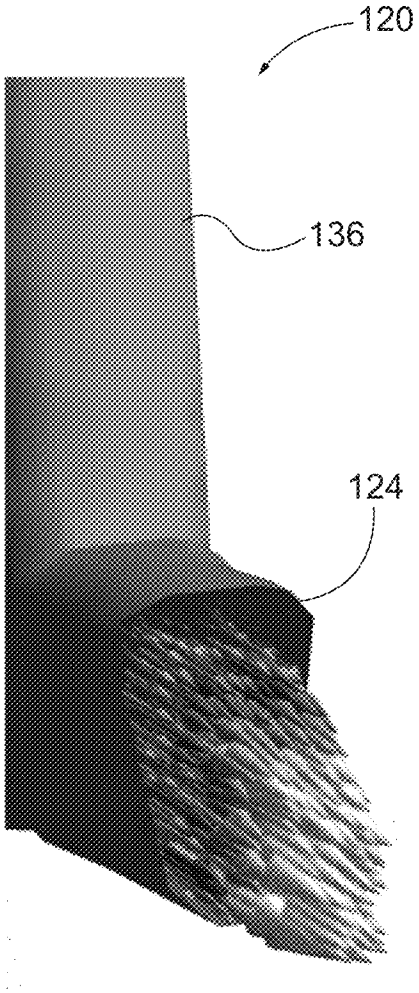
FIG. 14A
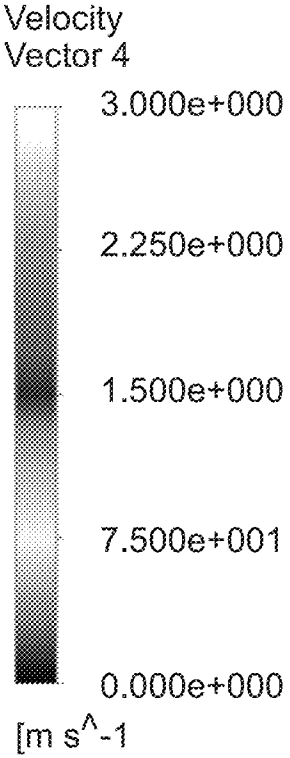

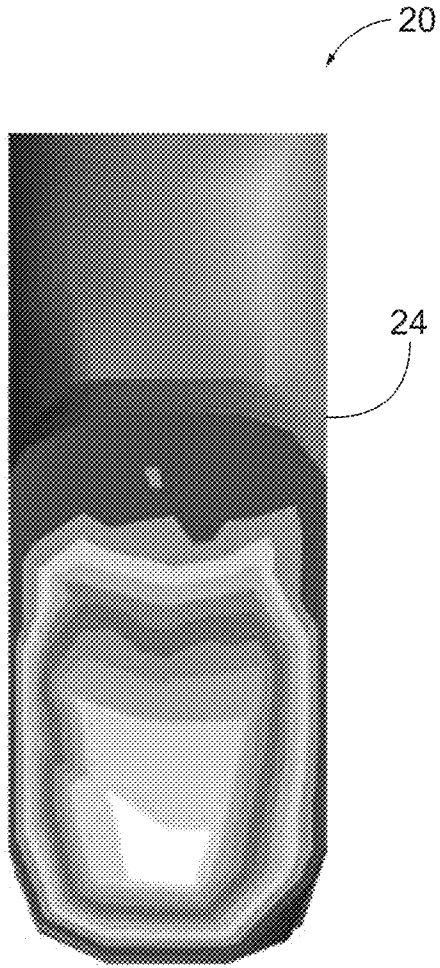
FIG. 15B
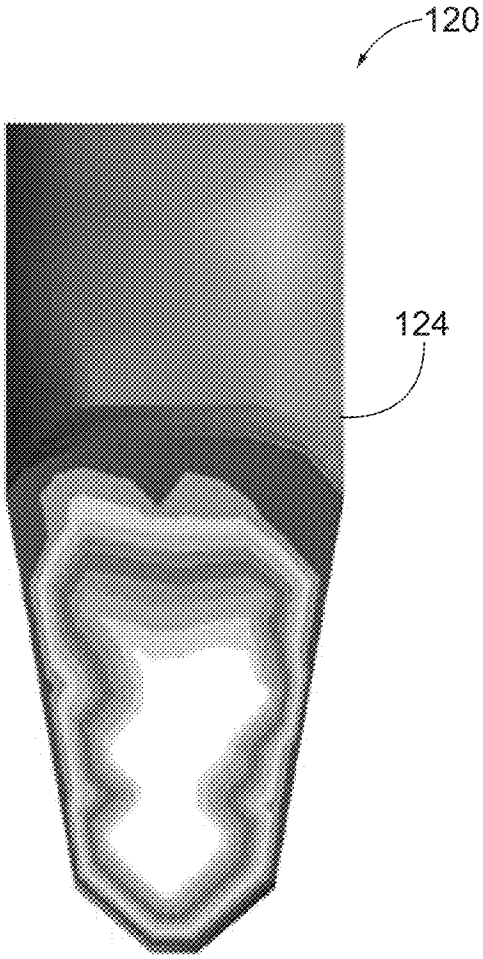
FIG. 15A
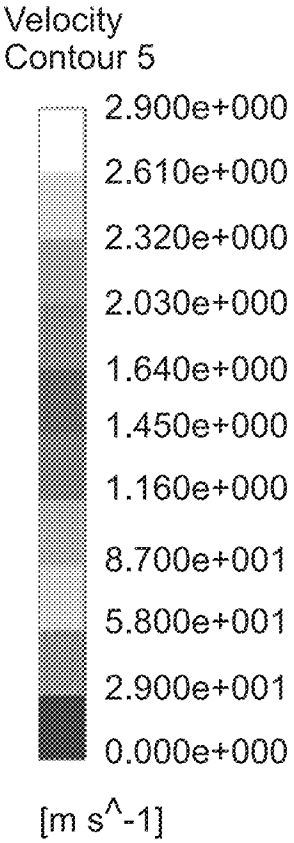

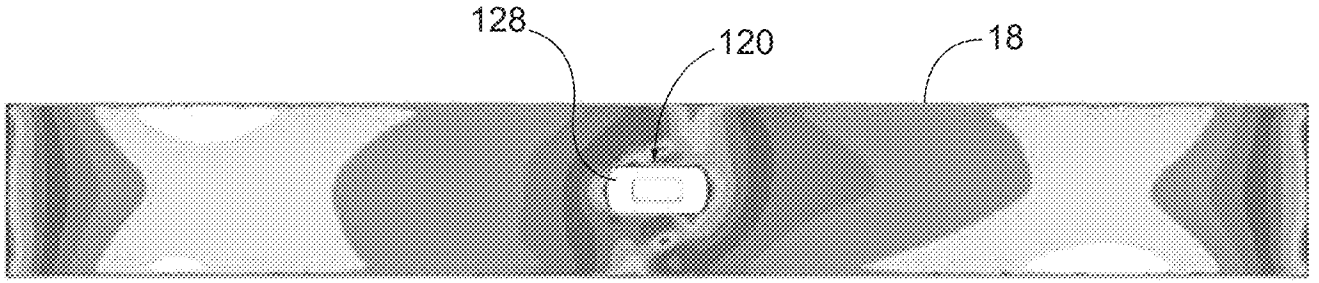
FIG. 18A
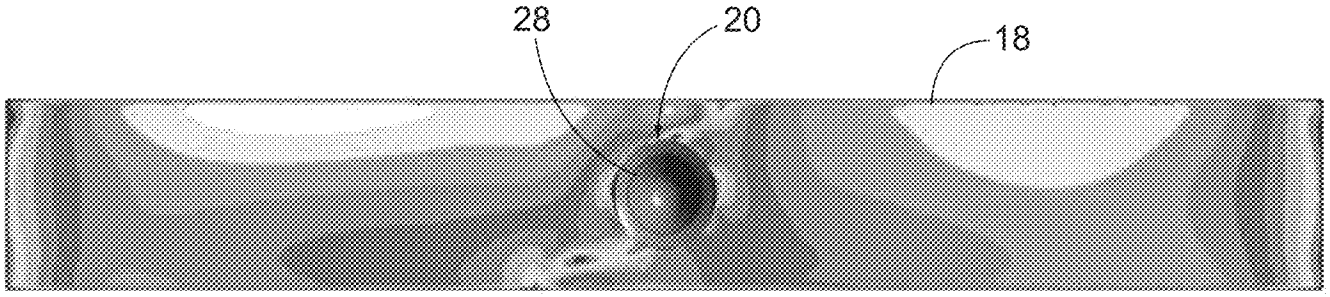
FIG. 18B
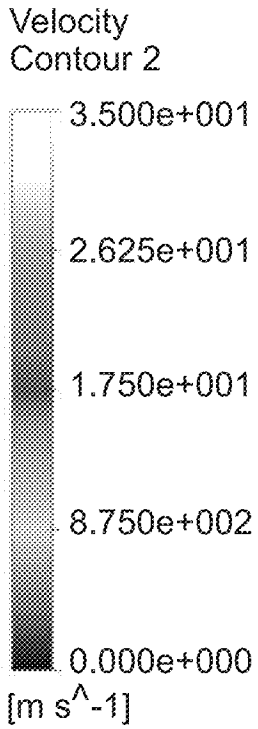

SUBMERGED ENTRY NOZZLE FOR CONTINUOUS CASTING

PRIORITY

This application claims priority to U.S. Provisional Application Ser. No. 62/622,363, entitled "Submerged Entry Nozzle with Conic Shape Ports for Fluid Flow Improvement in Continuous Casting Molds," filed on Jan. 26, 2018, the disclosure of which is incorporated by reference herein.

BACKGROUND

Continuous casting can be used in steelmaking to produce semi-finished steel shapes such as ingots, slabs, blooms, billets, etc. During a typical continuous casting process (10), as shown in FIG. 1, liquid steel (2) may be transferred to a ladle (12), where it may flow from the ladle (12) to a holding bath, or tundish (14). The liquid steel (2) may then flow into a mold (18) via a nozzle (20). In some versions, a sliding gate assembly (16) is selectively opened and closed to selectively start and stop the flow of the liquid steel (2) into the mold (18).

A typical continuous casting nozzle (20), or submerged entry nozzle (SEN), is shown in more detail in FIGS. 2 and 3. For instance, the nozzle (20) may comprise a bore (26) extending through the nozzle (20) along a central longitudinal axis (A) to a closed end (28) at a bottom portion (B) of the nozzle (20). As best seen in FIG. 2, the bore (26), at the bottom portion (B), is defined by substantially straight walls of the nozzle (20) that are substantially parallel with the longitudinal axis (A) to form a substantially cylindrical profile. A pair of ports (24) may then be positioned through opposing side surfaces of the nozzle (20) proximally above the closed end (28) of the nozzle (20). Accordingly, the liquid steel (2) may flow through the bore (26) of the nozzle (20), out of the ports (24), and into the mold (18).

In some instances, the throughput of liquid steel through the nozzle to the mold may be low, such as at steady state conditions or during ladle changes. This may result in sticking and/or bridging issues due to insufficient feeding of hot steel near the nozzle region, which may also cause insufficient mold powder melting. This may cause defects in the cast steel and/or shutdowns in the casting process. Accordingly, it may be desirable to improve the fluid flow through the SEN in a continuous casting process to reduce such sticking and/or bridging issues.

SUMMARY

A submerged entry nozzle is provided for use in a continuous casting process comprising a pair of triangular shaped ports. These triangular shaped ports may improve fluid flow at the discharge of the ports by increasing the velocity of the liquid steel exiting the nozzle and into the mold. This may reduce the sticking and/or bridging issues between the nozzle and the mold at steady state or low throughput conditions. Accordingly, such a continuous casting nozzle may improve the quality of the molded steel and the efficiency of the continuous casting process, while reducing costs.

DESCRIPTION OF FIGURES

It is believed that the present invention will be better understood from the following description of certain examples taken in conjunction with the accompanying drawings, in which like reference numerals identify like elements.

FIG. 14A depicts a perspective schematic view of a flow path of fluid through a port of the nozzle of FIG. 4.

FIG. 14B depicts a perspective schematic view of a flow path of fluid through a port of the prior art nozzle of FIG. 2.

FIG. 15A depicts a front schematic view of a flow path of fluid through a port of the nozzle of FIG. 4.

FIG. 15B depicts a front schematic view of a flow path of fluid through a port of the prior art nozzle of FIG. 2.

FIG. 18A depicts a bottom schematic view of a flow path of fluid through a pair of ports of the nozzle of FIG. 4 and into a mold.

FIG. 18B depicts a bottom schematic view of a flow path of fluid through a pair of ports of the prior art nozzle of FIG. 2 and into a mold.

Figure 1:
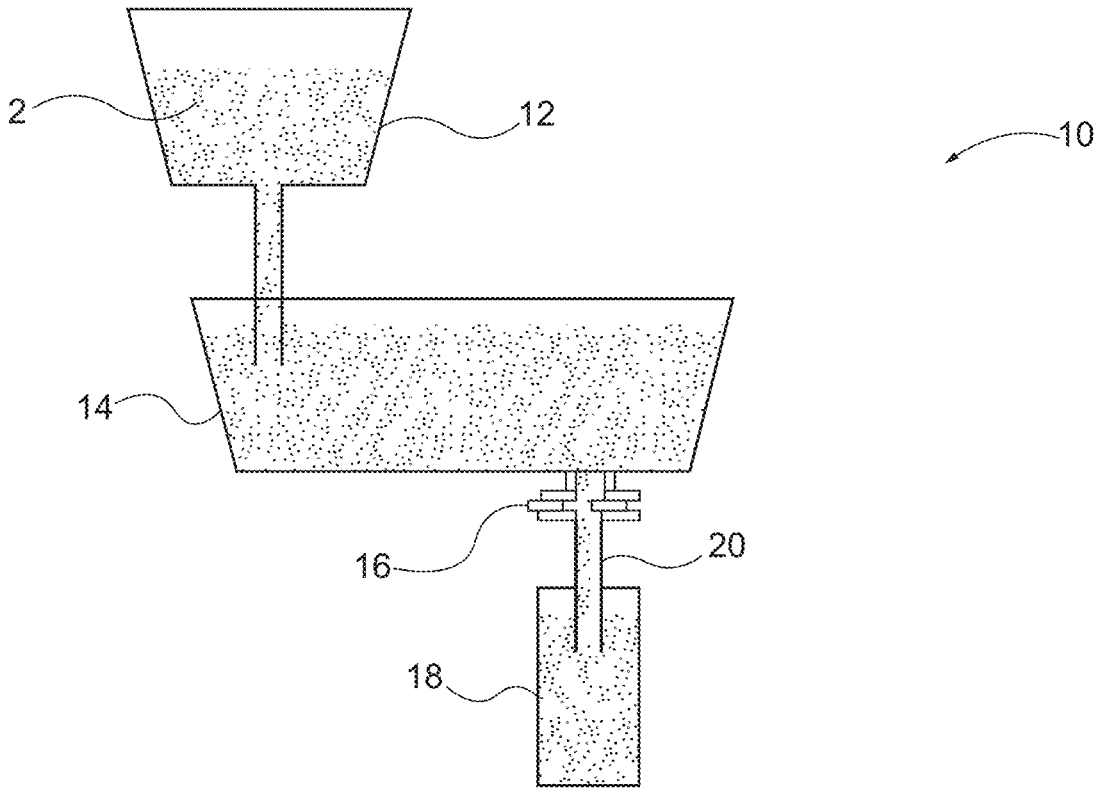
FIG. 1 depicts schematic of a continuous casting process.
Figure 2:
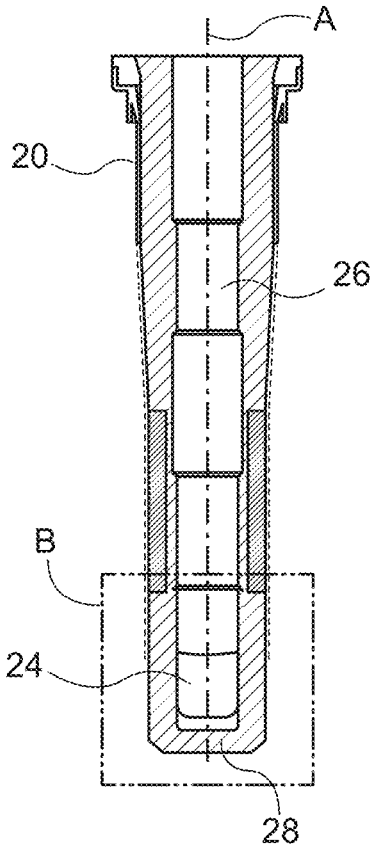
FIG. 2 (PRIOR ART)
FIG. 2 depicts a cross-sectional side view of a prior art continuous casting nozzle of the continuous casting process of FIG. 1.
Figure 3:
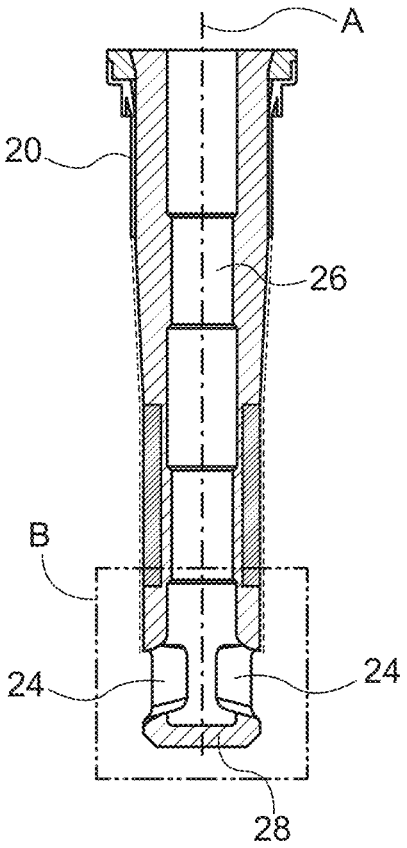
FIG. 3 (PRIOR ART)
FIG. 3 depicts a cross-sectional front view of the prior art nozzle of FIG. 2.

The drawings are not intended to be limiting in any way, and it is contemplated that various embodiments of the present disclosure may be carried out in a variety of other ways, including those not necessarily depicted in the drawings. The accompanying drawings incorporated in and forming a part of the specification illustrate several aspects of the present disclosure, and together with the descriptions serve to explain the principles and concepts of the present disclosure; it being understood, however, that the present disclosure is not limited to the precise arrangements shown.

DETAILED DESCRIPTION

The following description and embodiments of the present disclosure should not be used to limit the scope of the present disclosure. Other examples, features, aspects, embodiments, and advantages of the present disclosure will become apparent to those skilled in the art from the following description. As will be realized, the present disclosure may contemplate alternate embodiments than those exemplary embodiments specifically discussed herein without departing from the scope of the present disclosure. Accordingly, the drawings and descriptions should be regarded as illustrative in nature and not restrictive.

In some instances, throughput of fluid through a SEN in a continuous casting process may be low, such as during steady state conditions or ladle changes. Such conditions may lead to sticking and/or bridging of the liquid steel between the nozzle and the mold, which may cause insufficient feeding of hot steel near the nozzle region. These effects may be worsened when the SEN is positioned at a shallow submergence depth. It may thereby be desirable to improve the fluid flow exiting the SEN in a continuous casting process. Accordingly, a nozzle comprising triangular shaped ports that taper from a top portion to a bottom portion is provided to increase the fluid flow velocity at the discharging area of the SEN. This may reduce sticking and/or bridging issues and thereby improve the quality of the molded steel and the efficiency of the continuous casting process, while reducing costs.

Figure 4:
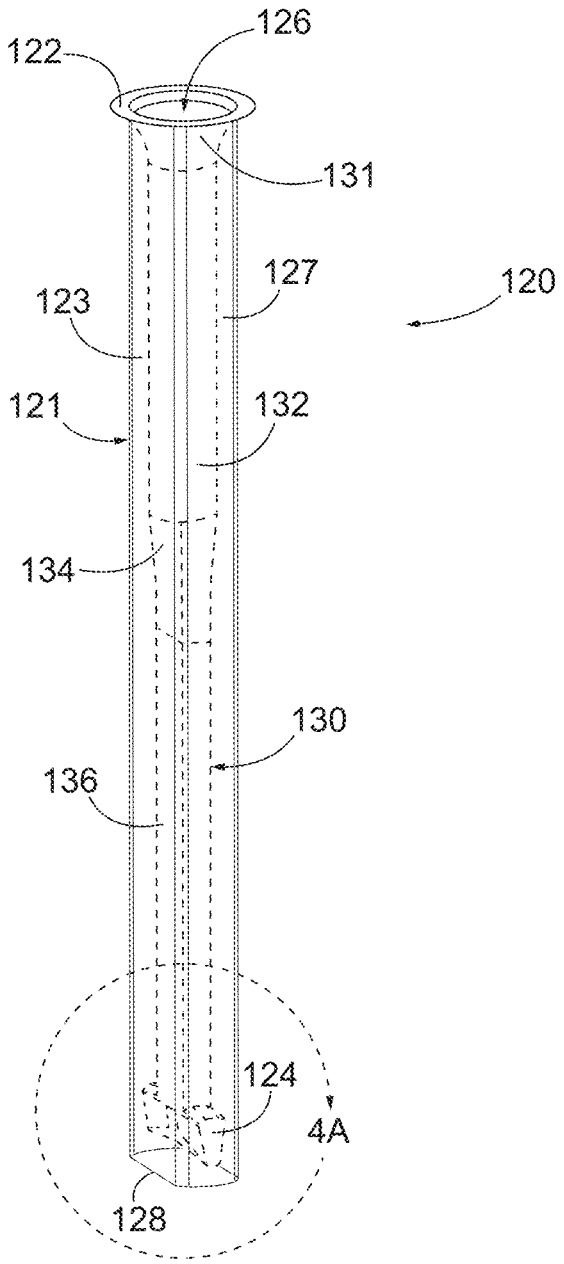
FIG. 4 depicts a top perspective view of a continuous casting nozzle comprising triangular shaped ports for use with the continuous casting process of FIG. 1.
Figure 4A:
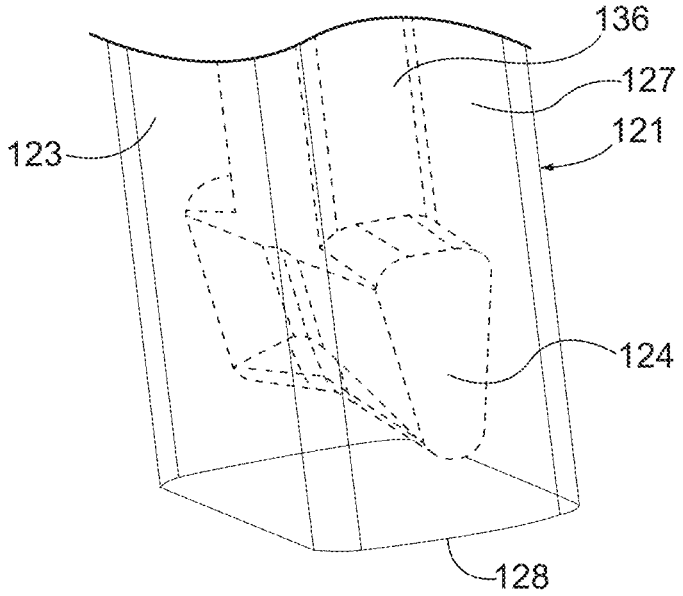
FIG. 4A depicts an enlarged partial perspective view of the nozzle of FIG. 4 encircled by line 4A of FIG. 4.
Figure 5:
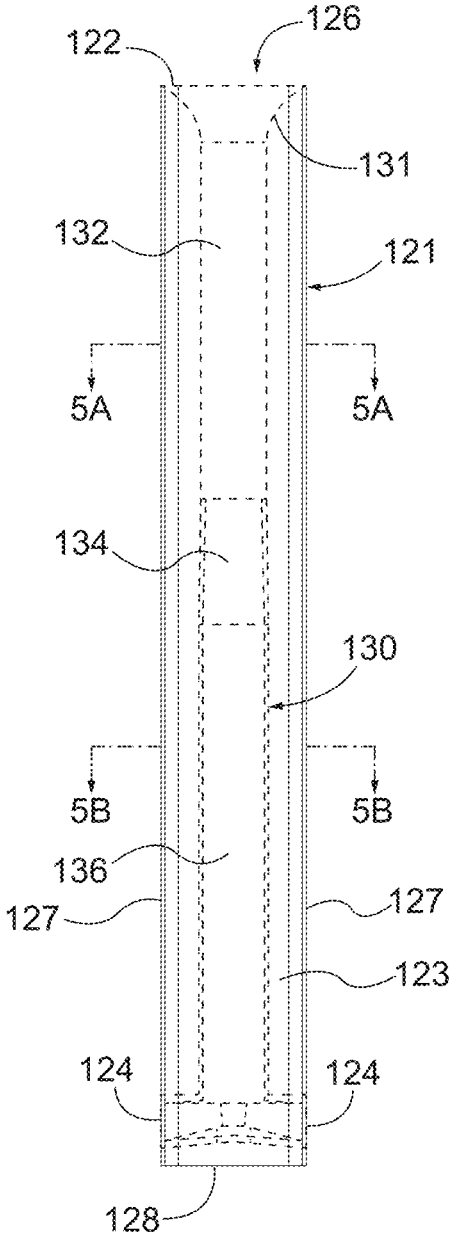
FIG. 5 depicts a front view of the nozzle of FIG. 4.
Figure 5A:
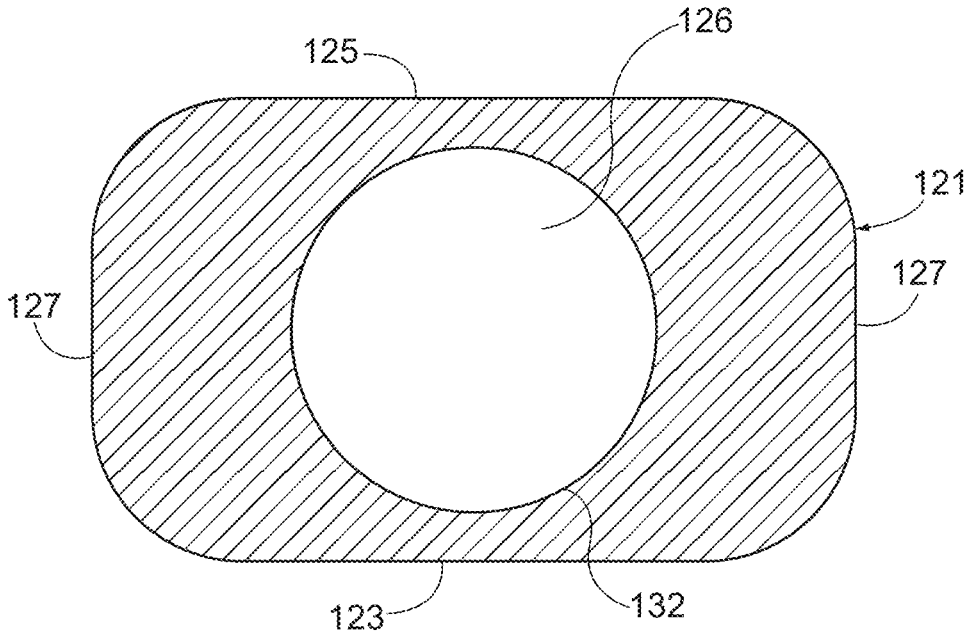
FIG. 5A depicts a cross-sectional view of the nozzle of FIG. 5 taken along line 5A-5A of FIG. 5.
Figure 5B:
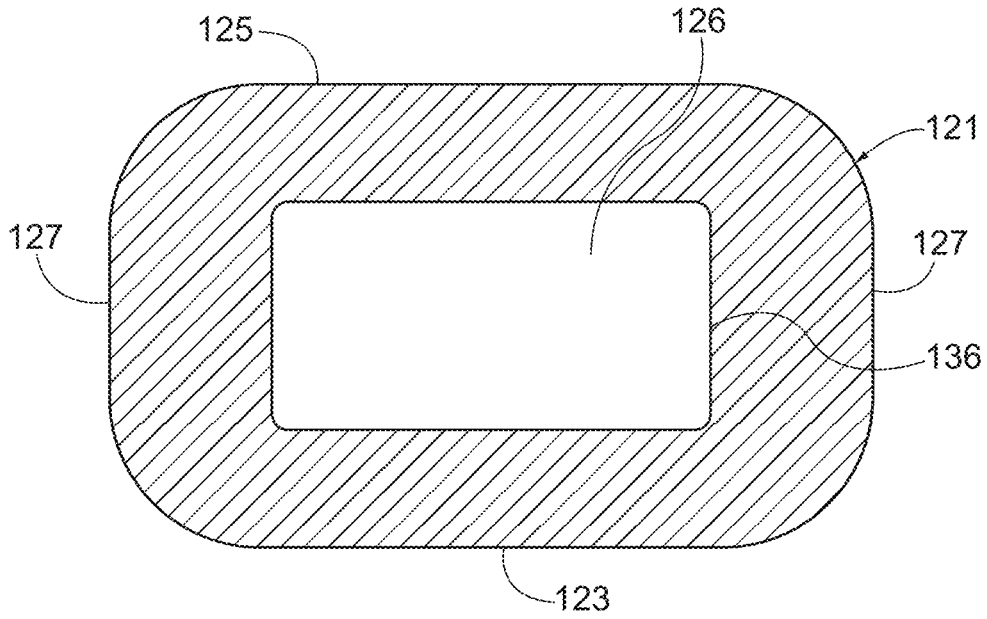
FIG. 5B depicts a cross-sectional view of the nozzle of FIG. 5 taken along line 5B-5B of FIG. 5.
Figure 6:
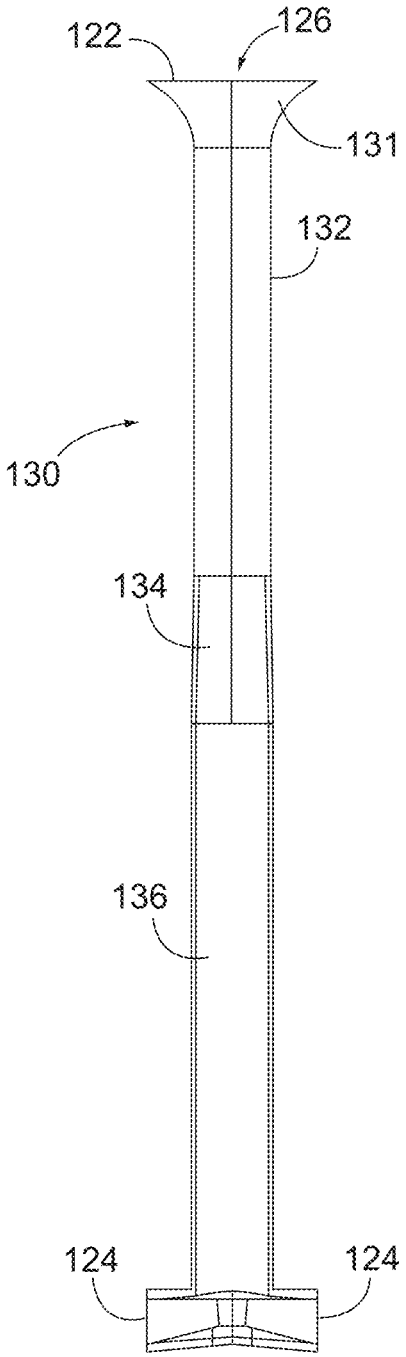
FIG. 6 depicts a front view of the nozzle of FIG. 4 with the exterior walls of the nozzle omitted to show the interior walls of the nozzle.

Referring to FIGS. 4-9, a submerged entry nozzle (120) is shown for use with the continuous casting process (10) depicted in FIG. 1. The nozzle (120) comprises an exterior surface (121) and a bore (126) formed longitudinally through the nozzle (120) by an interior surface (130). As best seen in FIGS. 4-5B, the exterior surface (121) of the nozzle (120) comprises a top surface (122), a bottom surface (128), a front surface (123), a rear surface (125), and a pair of opposing side surfaces (127). In the illustrated embodiment, the front and rear surfaces (123, 125) are substantially flat and the opposing side surfaces (127) are arcuate to form a generally obround cross-sectional profile, but other suitable shapes may be used such as oval, circular, rectangular, square, elliptical, etc. The bore (126) then extends from the open top surface (122) to a bottom portion of the nozzle (120) near the closed bottom surface (128).

The interior surface (130) is shown in more detail in FIGS. 6-9 with the exterior surface (121) omitted for illustrative purposes. In the illustrated embodiment, the interior surface (130) comprises a funnel portion (131), a cylindrical portion (132), a tapered portion (134), and a rectangular portion (136) to define the bore (126) within the interior surface (130). The funnel portion (131) is positioned adjacent to the top surface (122) of the nozzle (120) and comprises a generally circular shape that tapers inwardly to the cylindrical portion (132). The cylindrical portion (132) comprises a generally circular cross-sectional profile shape, as best seen in FIG. 5A, and extends within the nozzle (120) to the tapered portion (134). The tapered portion (134) then transitions the bore (126) from a generally circular cross-sectional profile shape to a generally rectangular cross-sectional profile shape. This generally rectangular cross-sectional profile shape continues to extend through the rectangular portion (136), as best seen in FIG. 5B, to the bottom portion of the nozzle (120).

Figure 7:
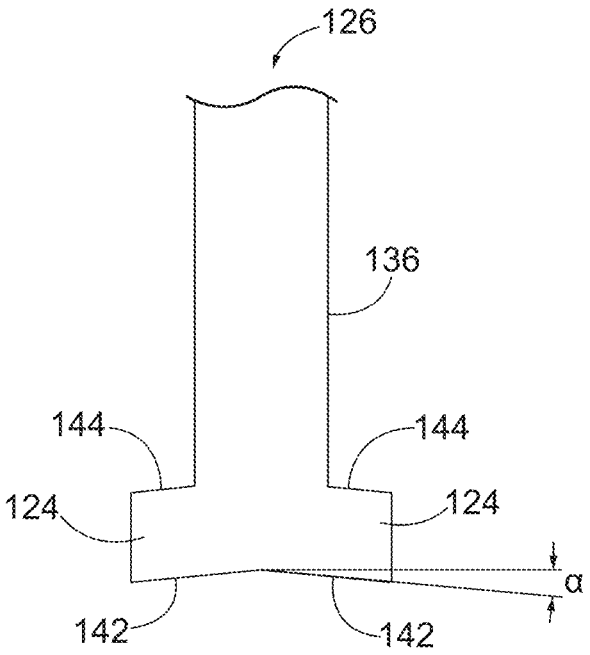
FIG. 7 depicts a partial cross-sectional view of a bottom portion of the nozzle of FIG. 6.
Figure 8:
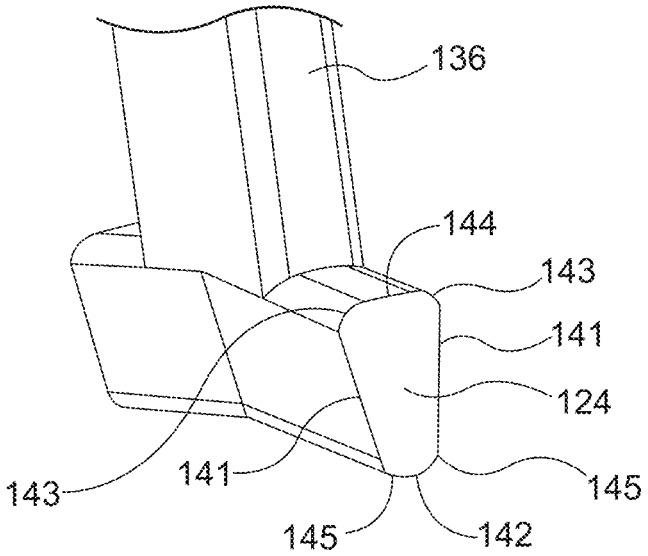
FIG. 8 depicts a partial perspective view of the bottom portion of the nozzle of FIG. 6.
Figure 9:
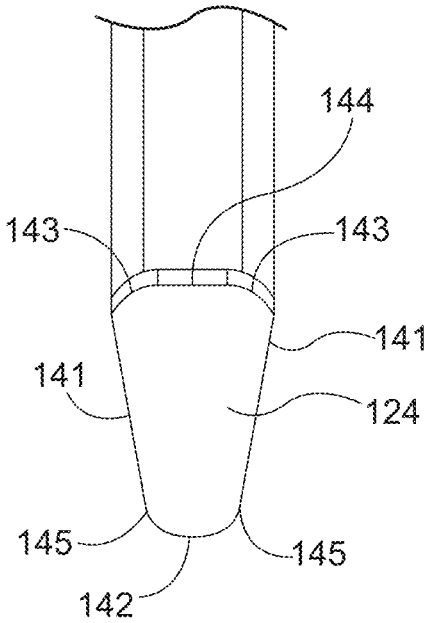
FIG. 9 depicts a partial side elevational view of the bottom portion of the nozzle of FIG. 6.

The bore (126) of the nozzle (120) then bifurcates at the bottom of the rectangular portion (136) to form a pair of ports (124) extending from the bore (126) to each side surface (127) of the nozzle (120). Referring to FIG. 7, each port (124) extends outwardly and downwardly within the nozzle (120) at an angle ($\alpha$) of between about 0° and about 15°, such as an angle ($\alpha$) of about 5°, though any other suitable angle can be used. The shape of each port (124), as best seen in FIGS. 8-9, comprises an inverted triangular profile that tapers from a wider top portion to a narrower bottom portion. For instance, each port (124) comprises a top surface (144), a bottom surface (142), and a pair of side surfaces (141) extending between the top surface (144) and the bottom surface (142). In the illustrated embodiment, the top surface (144) is wider than the bottom surface (142) such that each side surface (141) extends inwardly and downwardly between the top and bottom surfaces (144, 142). Each of the top, bottom, and side surfaces (144, 142, 141) may be substantially flat, with a first pair of rounded corners (143) positioned between the top and side surfaces (144, 141) and a second pair of rounded corners (145) positioned between the side and bottom surfaces (141, 142). Still other suitable shapes for the ports (124) will be apparent to one with ordinary skill in the art in view of the teachings herein.

Figure 10:
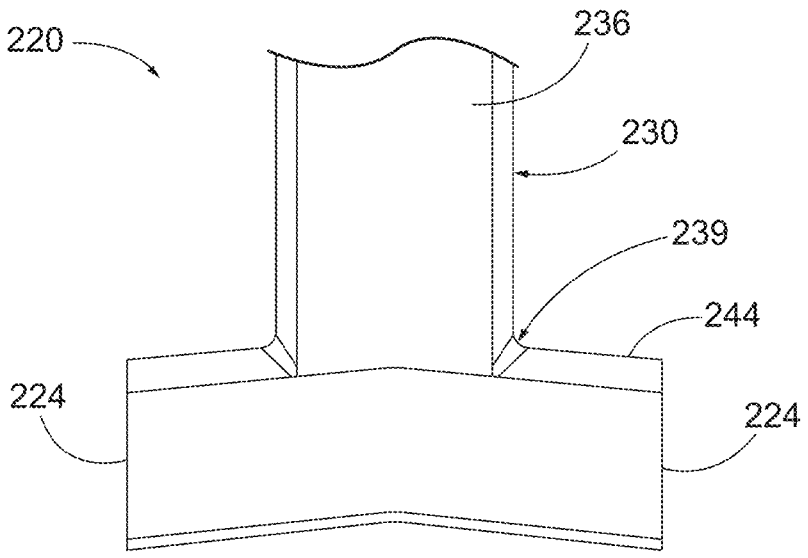
FIG. 10 depicts a partial front view of a bottom portion of another continuous casting nozzle comprising triangular shaped ports for use with the continuous casting process of FIG. 1 with the exterior walls of the nozzle omitted to show the interior walls of the nozzle.

For instance, FIGS. 10-13 show other illustrative configurations for SENs comprising triangular shaped ports. FIG. 10 shows a nozzle (220) that is similar to nozzle (120) described above, except that nozzle (220) comprises a fillet (239), or rounded corner, between the rectangular portion (236) of the interior surface (230) and the top surface (244) of each port (224). The fillet (239) may have a radius of between about 5 mm and about 20 mm, but other suitable dimensions may be used.

Figure 11:
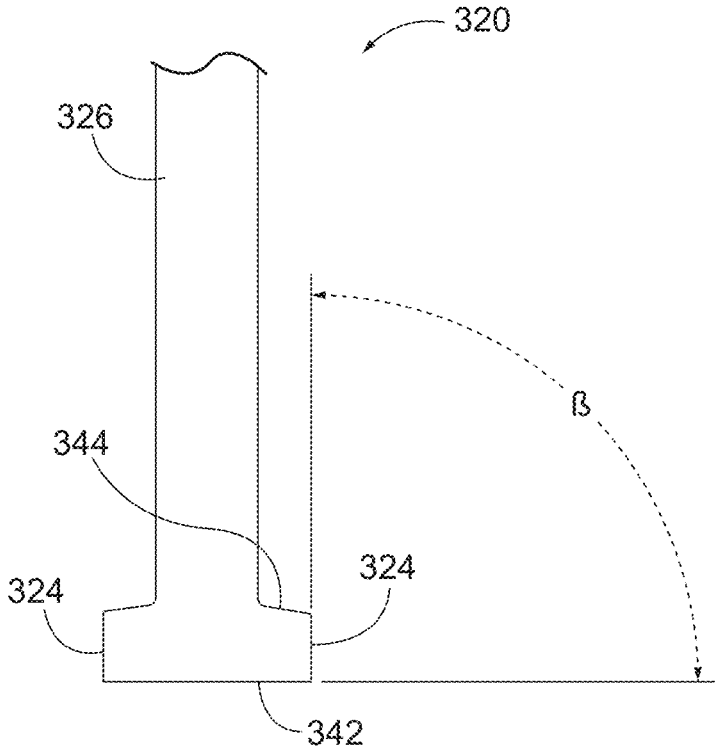
FIG. 11 depicts a partial cross-sectional view of a bottom portion of another continuous casting nozzle comprising triangular shaped ports for use with the continuous casting process of FIG. 1 with the exterior walls of the nozzle omitted to show the interior walls of the nozzle.

FIG. 11 shows another embodiment of a nozzle (320) that is similar to nozzle (120) described above, except that nozzle (320) comprises a pair of opposing ports (324) that extend outwardly from the bore (326) such that the bottom surface (342) of the port (324) forms a substantially right angle ((3) with a longitudinal axis of the bore (326). Accordingly, the top surface (344) of each port (324) may be angled downwardly and outwardly from the bore (326) while the bottom surface (342) of the port (324) is substantially horizontal such that the port (324) narrows from the bore (326) to the opening of the port (324).

Figure 12:
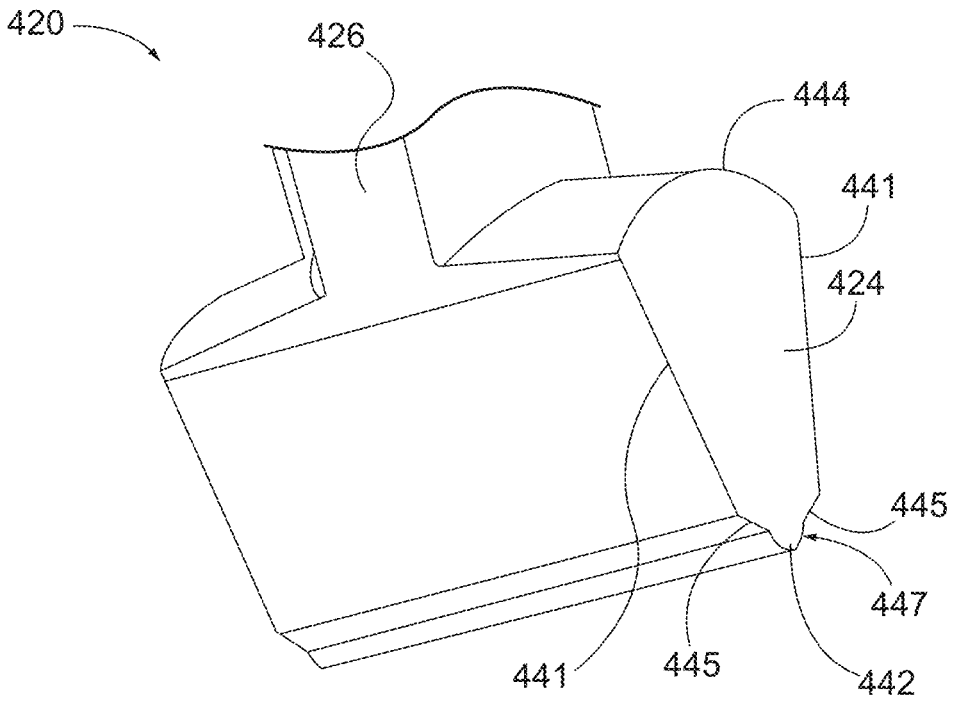
FIG. 12 depicts a partial perspective view of a bottom portion of another continuous casting nozzle for use with the continuous casting process of FIG. 1 with the exterior walls of the nozzle omitted to show the interior walls of the nozzle.
Figure 13:
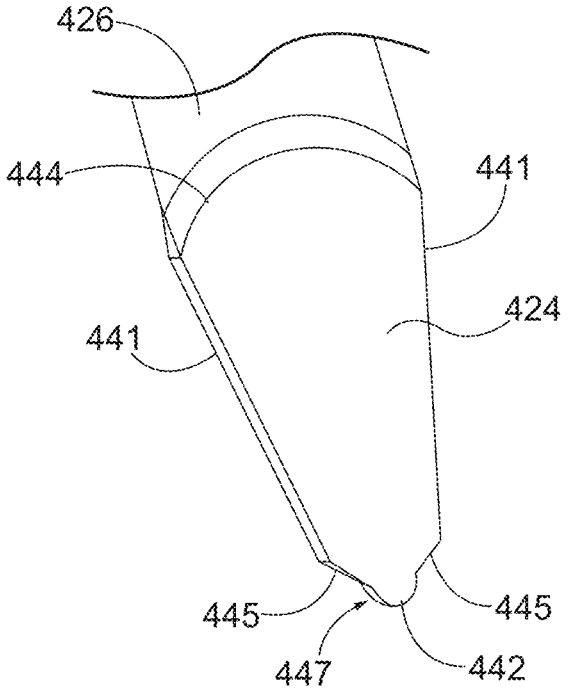
FIG. 13 depicts a side elevational view of the nozzle of FIG. 12.
Figure 16B:
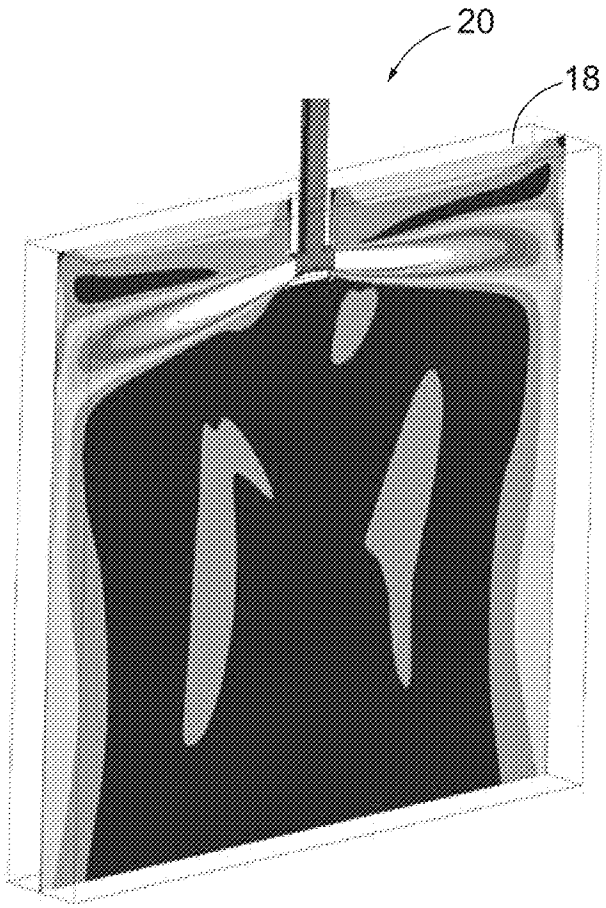
FIG. 16B depicts a perspective schematic view of a flow path of fluid through a pair of ports of the prior art nozzle of FIG. 2 and into a mold.
Figure 16A:
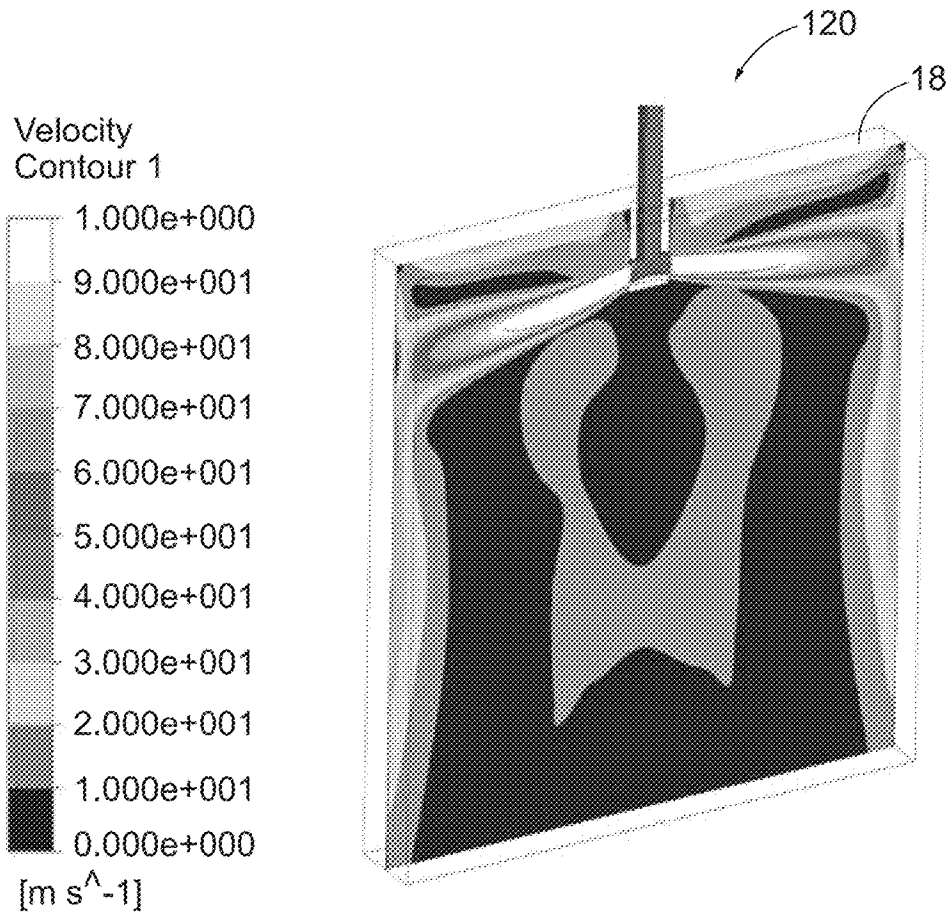
FIG. 16A depicts a perspective schematic view of a flow path of fluid through a pair of ports of the nozzle of FIG. 4 and into a mold.
Figures 17A, 17B:
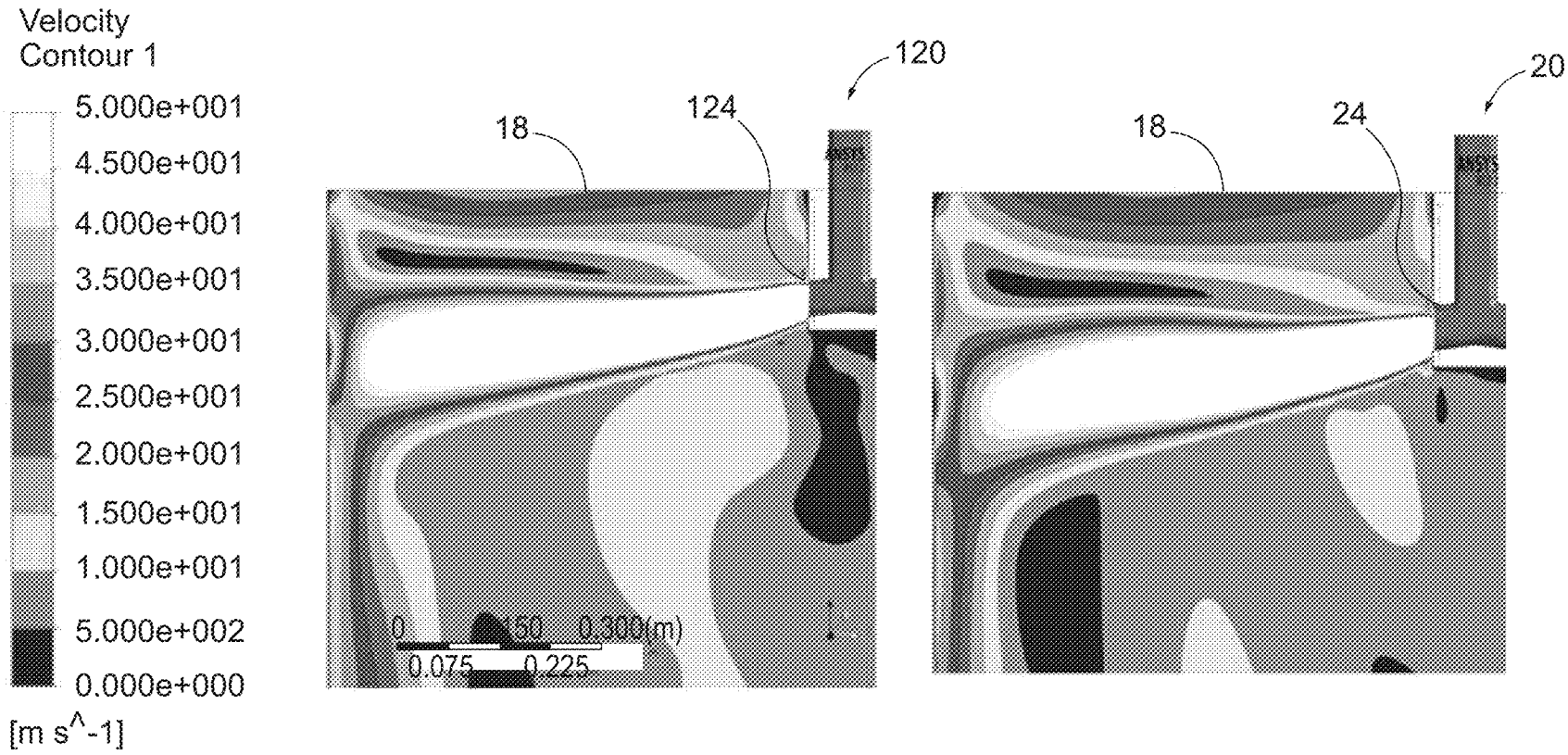
FIG. 17A depicts a front schematic view of a flow path of fluid through a port of the nozzle of FIG. 4 and into a mold.
FIG. 17B depicts a front schematic view of a flow path of fluid through a port of the prior art nozzle of FIG. 2 and into a mold.

FIGS. 12-13 shows another embodiment of a nozzle (420) that is similar to nozzle (320) described above, except that nozzle (420) comprises a channel (447) at the bottom surface (442) of each port (424). For instance, each port (424) may comprise an arcuate top surface (444) and tapered side surfaces (441) extending downwardly and inwardly to the bottom surface (442). The bottom surface (442) comprises a pair of tapered bottom surfaces (445) extending downwardly and inwardly to a circular channel (447) extending downwardly from the bottom surface (442). The channel (447) may thereby extend between each opening of the ports (424). Still other suitable configurations for ports (124, 224, 324, 424) may be used.

A SEN comprising triangular shaped ports can thereby be incorporated into a continuous casting process (10). For instance, the nozzle (120, 220, 320, 420) can be positioned within a mold (18) such that the ports (124, 224, 324, 424) of the nozzle (120, 220, 320, 420) are submerged within the mold (18). Liquid steel (2) may then flow through the bore (126, 226, 326, 426) of the nozzle (120, 220, 320, 420), out of the ports (124, 224, 324, 424), and into the mold (18).

As shown in FIGS. 14A-18B, the velocity of the liquid steel discharged at the openings of the ports (124) comprising a triangular shaped profile is higher than at the openings of the ports (24) of a prior art nozzle (20) comprising straight ports (24). For instance, the simulations performed with the prior art nozzle (20) show that the upper rolls of the liquid steel exiting the ports (24) may not be well developed, resulting in low velocities at the meniscus. The liquid steel may also not be properly fed near the SEN (20) regions, which also may prevent proper lubrication of the steel. The simulations performed with the triangular ports (124) show an improved fluid flow at the discharge of the ports (124) with an increased velocity as compared to the prior art nozzle (20). Such an increased velocity may help in completing the upper loops of the liquid steel exiting the ports (124) at shallow and deep submergence depths. This may also reduce problems of sticking and/or bridging of solidified steel between the nozzle (124) and the mold (18), as well as unexpected turnarounds. Further, the improved fluid flow may ensure a submerged ladle shroud operation during ladle changes and proper fluid flow in the mold when casting long sequences, add more flexibility to reduce casting speeds at ladle changes, and provide a more uniform erosion. Still other suitable configurations and methods for nozzles (120, 220, 320, 420) comprising triangular shaped ports (124, 224, 324, 424) will be apparent to one with ordinary skill in the art in view of the teachings herein.

EXAMPLES

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

EXAMPLES

Example 1

A submerged entry nozzle for continuous casting comprising an exterior surface and an interior surface defining a bore extending from a top surface of the nozzle to a bottom portion of the nozzle, wherein the nozzle comprises a pair of ports extending from a bottom portion of the bore to the exterior surface, wherein each port of the pair of ports comprises a triangular shaped opening at the exterior surface that narrows from a top portion of each port to a bottom portion of each port.

Example 2

The nozzle of example 1, wherein the exterior surface comprises a substantially flat front and rear surface and a pair of arcuate side surfaces between the front and rear surfaces to form a generally obround cross-sectional profile.

Example 3

The nozzle of example 1 or 2, wherein the bore comprises a substantially cylindrical portion extending downwardly from the top surface of the nozzle.

Example 4

The nozzle of example 3, wherein the bore comprises a tapered portion coupled with the substantially cylindrical portion, wherein the tapered portion transitions from a substantially cylindrical shape to a substantially rectangular shape.

Example 5

The nozzle of any of the examples 1 to 4, wherein the bore comprises a substantially rectangular portion, wherein the pair of ports are coupled with the substantially rectangular portion.

Example 6

The nozzle of any of the examples 1 to 5, wherein each port of the pair of ports extends outwardly and downwardly from the bore at an angle of between about 0 degrees and about 15 degrees.

Example 7

The nozzle of any of the examples 1 to 6, wherein each port of the pair of ports comprises a top surface, a bottom surface, and a pair of side surfaces extending between the top and bottom surfaces, wherein the top, bottom, and side surfaces are substantially flat, wherein each of the side surfaces are tapered downwardly and inwardly from the top surface to the bottom surface.

Example 8

The nozzle of example 7, wherein each port of the pair of ports comprises rounded corners between the top, bottom, and side surfaces.

Example 9

The nozzle of any of the examples 1 to 8, wherein the nozzle comprises a fillet between the bore and a top surface of each port of the pair of ports.

Example 10

The nozzle of any of the examples 1 to 9, wherein each port of the pair of ports comprises a bottom surface positioned at a substantially right angle with a longitudinal axis of the bore.

Example 11

The nozzle of any of the examples 1 to 10, wherein each port of the pair of ports comprises a channel extending along a length of a bottom surface of each port.

Example 12

A continuous casting system comprising a nozzle and a mold, wherein the nozzle comprises a bore extending from a top surface of the nozzle to a bottom portion of the nozzle, wherein the nozzle comprises at least one port extending from a bottom portion of the bore to an opening at the bottom portion of the nozzle, wherein the bottom portion of the nozzle is submerged within the mold, wherein the opening of the at least one port decreases in width from a top portion of the opening to a bottom portion of the opening.

Example 13

The system of example 12, wherein the opening of the at least one port comprises an inverted triangular shape.

Example 14

The system of example 12 or 13, wherein the at least one port extends outwardly and downwardly from the bore at an angle of between about 0 degrees and about 15 degrees.

Example 15

The system of any of the examples 12 to 14, wherein the nozzle comprises a fillet between the bore and a top surface of the at least one port.

Example 16

The system of any of the examples 12 to 15, wherein the at least one port comprises a bottom surface positioned at a substantially right angle with a longitudinal axis of the bore.

Example 17

The system of any of the examples 12 to 16, wherein the at least one port comprises a channel extending along a length of a bottom surface of the port.

Example 18

A method of operating a continuous casting system comprising: providing a nozzle comprising a bore extending longitudinally through the nozzle and at least one port extending from the bore to an exterior surface of the nozzle, wherein the at least one port comprises a width that decreases from a top portion of the at least one port to a bottom portion of the at least one port; positioning the nozzle within a mold such that the at least one port is submerged in the mold; and flowing fluid through the bore and discharging the fluid into the mold via the at least one port.

Example 19

The method of example 18, wherein the at least one port comprises a triangular shape.

Example 20

The method of examples 18 or 19, wherein the at least one port is angled downwardly as the at least one port extends from the bore to the exterior surface.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A submerged entry nozzle for continuous casting comprising an exterior surface and an interior surface defining a bore extending from a top surface of the nozzle to a bottom portion of the nozzle, wherein the nozzle comprises a pair of ports extending from a bottom portion of the bore to the exterior surface, wherein each port of the pair of ports comprises a top surface, a bottom surface, and a pair of side surfaces extending between the top surface and the bottom surface to form a triangular shaped opening extending from a central portion of the nozzle to the exterior surface, wherein the top surface extends continuously downwardly at a first angle from the central portion to the exterior surface, wherein the bottom surface extends continuously outwardly from the central portion to the exterior surface at a second angle that is less than the first angle of the top surface such that a distance between the top surface and the bottom surface becomes smaller as the top and bottom surfaces extend from the central portion to the exterior surface, and wherein the triangular shaped opening narrows from a top portion of each port to a bottom portion of each port such that each port is configured to increase a velocity of the fluid as the fluid flows through each port.

2. The nozzle of claim 1, wherein the exterior surface comprises a substantially flat front and rear surface and a pair of arcuate side surfaces between the front and rear surfaces to form a generally obround cross-sectional profile.

3. The nozzle of claim 1, wherein the bore comprises a substantially cylindrical portion extending downwardly from the top surface of the nozzle.

4. The nozzle of claim 3, wherein the bore comprises a tapered portion coupled with the substantially cylindrical portion, wherein the tapered portion transitions from a substantially cylindrical shape to a substantially rectangular shape.

5. The nozzle of claim 1, wherein the bore comprises a substantially rectangular portion, wherein the pair of ports are coupled with the substantially rectangular portion.

6. The nozzle of claim 1, wherein each port of the pair of ports extends outwardly and downwardly from the bore at an angle of between about 0 degrees and about 15 degrees.

7. The nozzle of claim 1, wherein each port of the pair of ports comprises rounded corners between the top, bottom, and side surfaces.

8. The nozzle of claim 1, wherein the nozzle comprises a fillet between the bore and the top surface of each port of the pair of ports.

9. The nozzle of claim 1, wherein the bottom surface of each port of the pair of ports is positioned at a substantially right angle with a longitudinal axis of the bore.

10. The nozzle of claim 1, wherein each port of the pair of ports comprises a channel extending along a length of the bottom surface of each port.

11. The nozzle of claim 1, wherein the triangular shaped opening of each port is configured to increase a velocity of the fluid to more than about 3 meters per second.

12. A method of operating a continuous casting system comprising:

providing a nozzle comprising a bore extending longitudinally through the nozzle and a pair of ports extending from the bore to an exterior surface of the nozzle, wherein each port of the pair of ports comprises a width that decreases from a top portion to a bottom portion of the port, wherein each port of the pair of ports comprises a top surface and a bottom surface that each extend continuously downwardly from the bore to the exterior surface, wherein the bottom surface extends at an angle that is less than an angle of the top surface such that a distance between the top surface and the bottom surface becomes smaller as the top and bottom surfaces extend from the bore to the exterior surface;

positioning the nozzle within a mold such that each port of the pair of ports is submerged in the mold; and flowing fluid through the bore and discharging an entirety of the fluid into the mold via the pair of ports such that the pair of ports increase a velocity of the fluid as the fluid flows through the pair of ports.

13. The method of claim 12, wherein each port of the pair of ports comprises a triangular shape.

14. The method of claim 12, wherein each port of the pair of ports is angled downwardly as the at least one port extends from the bore to the exterior surface.

* * * * *